United States Patent [19]

Kato et al.

[11] Patent Number: 4,539,833

[45] Date of Patent: Sep. 10, 1985

[54] ROLLING MILL WITH FLATNESS CONTROL FACILITY

[75] Inventors: Heiji Kato, Yokosuka; Kanji Kizaki, Ebina; Seizo Baba, Tokyo, all of Japan

[73] Assignee: Ishikawajima-Harima Jukogyo Kabushiki Kaisha, Japan

[21] Appl. No.: 568,118

[22] Filed: Jan. 4, 1984

[30] Foreign Application Priority Data

Jan. 18, 1983 [JP] Japan ..... 58-6366
Jan. 19, 1983 [JP] Japan ..... 58-6819

[51] Int. Cl.[3] ..... B21B 13/14
[52] U.S. Cl. ..... 72/243; 72/241
[58] Field of Search ..... 72/240, 241, 242, 243, 72/199, 245

[56] References Cited

FOREIGN PATENT DOCUMENTS 17552 2/1978 Japan .
59518 5/1981 Japan ..... 72/243
171504 10/1982 Japan ..... 72/243

*Primary Examiner*—Lowell A. Larson
*Assistant Examiner*—Jorji M. Griffin

[57] ABSTRACT

Disclosed is a rolling mill in which an intermediate roll is interposed between a work roll and a backup roll and is offset by a suitable distance in the direction of the rolling line. A horizontal bending force is exerted to the intermediate roll so that the flatness of the rolled product can be controlled with a higher degree of accuracy.

5 Claims, 5 Drawing Figures

ROLLING MILL WITH FLATNESS CONTROL FACILITY

BACKGROUND OF THE INVENTION

The present invention relates to a rolling mill including a mechanism for controlling the flatness of the rolled product.

In order to control the sectional flatness of the rolled product across its width direction, various methods for bending the work rolls in a four high rolling mill have been developed in recent years. However, such methods adapted hitherto are found to have a limited capability of controlling the flatness of the rolled product. Especially when the width of stocks or workpieces varies widely, the satisfactory control cannot be accomplished.

In order to obtain a rolled product with a uniform flatness and especially having a small variation of thickness across its width, it is important to reduce deformation of the work roll due to the rolling load as far as practicable and, at the same time, increase the capacity for correction by roll bending. However, in the conventional rolling mills, the ends of a work roll receive the bending moment due to the load owing to the contact with a backup roll. As a result, the portions adjacent to the edges of the rolled product are considerably deformed. Especially when the width of a stock or workpiece changes, the above-described bending moment also varies. The narrower the width of the stock, the work rolls receive greater bending moments so that they are considerably deflected, resulting in thickness variation over a wide range. Furthermore, the work rolls are thermally expanded and such thermal expansions are not uniform in the axial direction so that a thermal crown results. In addition, due to the wear of the work rolls, the initial roll crown is varied.

In order to overcome the above and other problems, there must be provided a powerful roll bending device so that the roll crown may be freely varied. However, in the conventional rolling mill, the work rolls are restrained by the backup rolls with a high degree of bending rigidity so that the roll bending effects are exerted only at the portions adjacent to the ends of the work rolls. Furthermore, the roll bending force is limited by the rigidity of the roll necks and the life of bearings. As a result, the roll bending force is limited so that the roll crown cannot be varied as desired. Thus it has been impossible to overcome the above and other problems. As a result, with the conventional rolling mills, whenever the thickness of the stock is varied, the roll crown must be varied accordingly. Therefore the work rolls must be replaced very frequently so that the operation efficiency is considerably decreased. In addition, many work rolls with various crowns must be provided so that the costs are increased.

One of the objects of the present invention is therefore to provide a rolling mill with a considerably improved capability of controlling the flatness of the rolled product.

The above and other objects, effects, features and advantages of the present invention will become more apparent from the following description of preferred embodiments thereof taken in conjunction with the accompanying drawings.

BRIEF DESCRIPTION OF THE DRAWINGS

The same reference numerals are used to designate similar parts throughout the figures.

DESCRIPTION OF THE PREFERRED EMBODIMENTS

Figure 1:
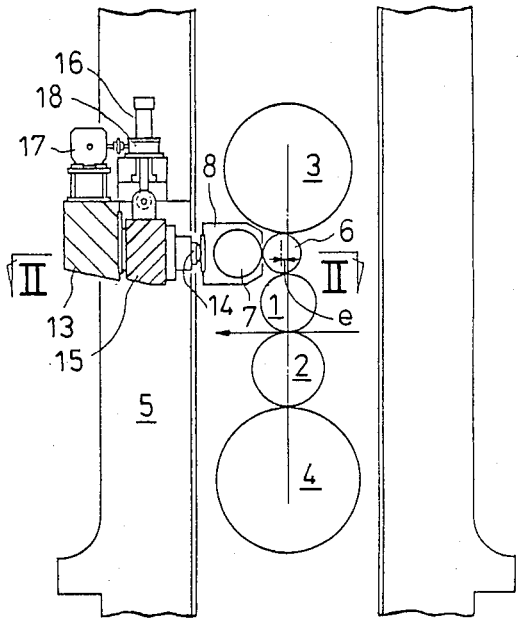
FIG. 1 is a schematic side view of a rolling mill in accordance with the present invention.
Figure 2:
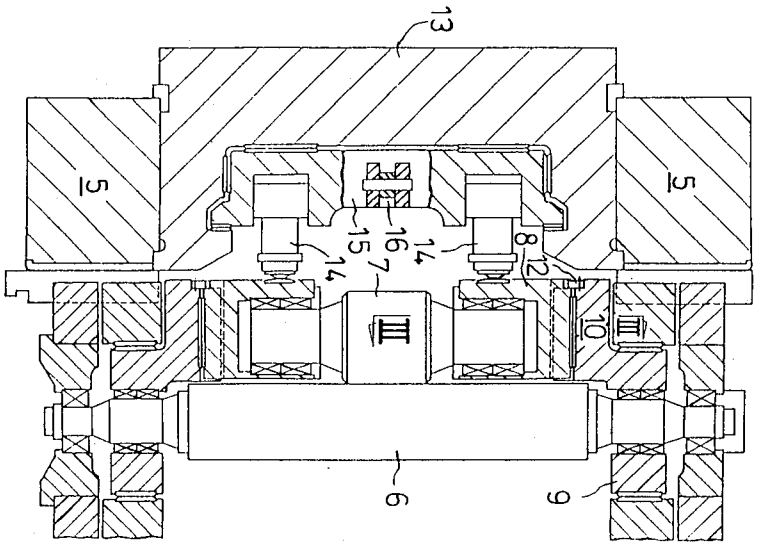
FIG. 2 is a sectional view taken along the line II—II of FIG. 1.

Referring first to FIGS. 1 and 2, reference numerals 1 and 2 designate work rolls; 3 and 4, backup rolls; and 5, housings.

Figure 3:
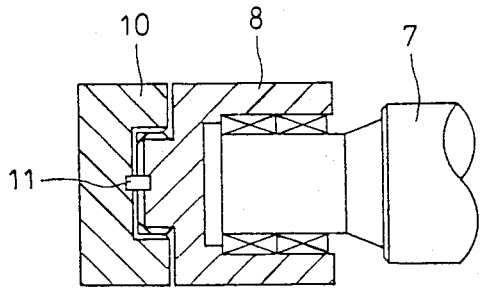
FIG. 3. is a sectional view taken along the line III—III of FIG. 2.

An intermediate roll 6 with a small diameter is interposed between the upper work roll 1 and the upper backup roll 3 and is offset by a suitable distance e in the downstream direction from the reduction line interconnecting the axis of the upper and lower backup rolls 3 and 4. A pressure roll 7 disposed on the offset side of the intermediate roll 6 is pressed against the lengthwise central portion of the intermediate roll 6 and is extended in parallel therewith. As shown in FIG. 3, each of bearing boxes 8 for the pressure roll 7 is made into engagement with a guide member 10, which is extended in the offset side from a bearing box 9 of the intermediate roll 6, in such a way that the vertical movement of the bearing box 8 can be prevented while the horizontal movement in the direction of the rolling line may be permitted. Reference numeral 11 denotes a key; and 12, a retaining member for the bearing box 8.

A supporting beam 13 is extended between the right and left housings 5 (the beam 13 being shown as being extended vertically in FIG. 2) and carries a vertically movable cylinder block 15. The cylinder block 15 is provided with cylinders 14 which cause the pressure roll 7 to press against the intermediate roll 6 through the bearing boxes 8. The cylinder block 15 is suspended from a balance cylinder 16 (See FIG. 1) which in turn is securely mounted on the supporting beam 13. The balance cylinder 16 is drivingly coupled through a worm gear train 18 to a motor 17 mounted on the supporting beam 13 so that the balance cylinder 16 may be extended or retracted.

In order to control the flatness of the rolled product, the cylinders 14 of the cylinder block 15 are extended so as to press against the bearing boxes, whereby the pressure roll 7 is pressed against the intermediate roll 6. As a result, the intermediate roll 6 is horizontally deflected at its lengthwise center and is vertically pressed against the upper work roll 1 so that the deflection of the upper work roll 1 along its length can be adjusted. When the pressure roll 7 is greatly pressed against the intermediate roll 6, the distance between the upper and lower work rolls 1 and 2 is reduced so that the thickness of the rolled product is reduced. On the other hand, when the pressure applied from the pressure roll 7 to the intermediate roll 6 is decreased, the thickness of the rolled product is increased.

As described above, according to the present invention, the intermediate roll 6 with a small diameter is controlled in the horizontal direction so that the deflection of the upper work roll 1 can be freely adjusted and consequently the flatness of the rolled product can be freely controlled. When the above-mentioned operation is effected in combination with the bending control in the vertical direction of the upper and lower work rolls 1 and 2, the flatness of the rolled product can be controlled over a wide range with a high degree of accuracy.

Meanwhile, it is necessary to vertically move the rolls depending upon the thickness of the rolled product. According to the present invention, the bearing boxes 8 of the pressure roll 7 are made into engagement with the guide members 10 of the bearing boxes 9 for the intermediate roll 6. The bearing boxes 8 can be moved in the rolling line direction, but their vertical movement is not permitted. Since the bearing boxes 8 are connected to the bearing boxes 9, the pressure roll 7 and the intermediate roll 6 can vertically move in unison. If the cylinders 14 are disengaged from the bearing boxes 8, the motor 17 may be driven so that the balance cylinder 16 is extended or retracted and consequently the cylinder block 15 is vertically moved.

Figure 4:
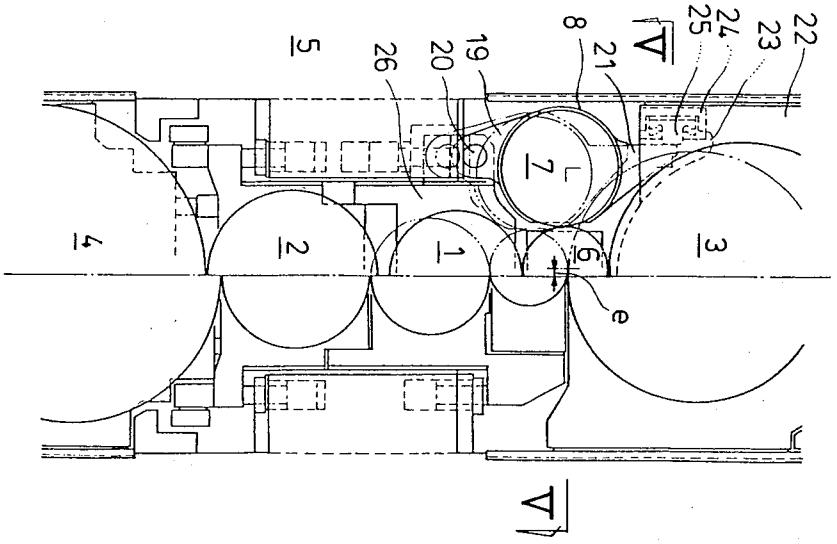
FIG. 4 is a schematic side view of a second embodiment of a rolling mill in accordance with the present invention.
Figure 5:
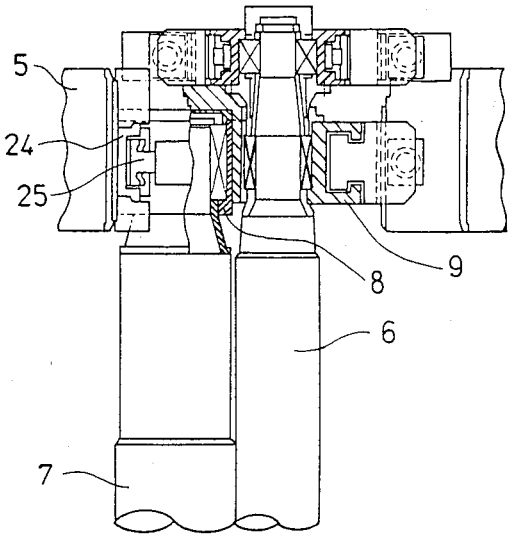
FIG. 5 is a sectional view taken along the line V—V of FIG. 4.

Referring next to FIGS. 4 and 5, a second embodiment of the present invention will be described. A bracket 19 is extended downwardly from each of the bearing boxes 8 of the pressure roll 7 and is pivoted with a pin 20 to a bearing box 26 of the upper work roll 1. A projection 21 is entended upwardly from the bearing box 8 and is loosely fitted into a recess 23 formed at the lower portion of a bearing box 22 of the upper backup roll 3. The free end of a piston rod 25 of a cylinder 24 disposed at the recess 23 is pressed against the cylindrical surface of the backup roll 3. Therefore, when the piston rod 25 is extended, the pressure roll 7 is horizontally pressed against the intermediate roll 6.

In order to control the flatness of the rolled product, the piston rod 25 of the cylinder 24 is extended so as to press the projection 21 of the bearing box 8. As a result, the bearing box 8 is caused to rotate about the pin 20 of the bracket 19 so that the pressure roll 7 is pressed against the lengthwise center of the intermediate roll 6. The horizontal deflection of the intermediate roll 6 causes the upper work roll 1 to be vertically pressed so that the deflection in the longitudinal direction of the upper work roll 1 can be adjusted. As is the case of the first embodiment, when the pressure roll 7 is greatly pressed against the intermediate roll 6, the distance between the upper and lower work rolls 1 and 2 is reduced so that the thickness of the rolled product is decreased. On the other hand, when the force exerted from the pressure roll 7 to the intermediate roll 6 is reduced, the thickness of the rolled product is increased.

As described above, the intermediate roll 6 with a small diameter is horizontally controlled to vertically control the upper work roll 1 with a small diameter so that the rolling or reduction force can be reduced and consequently the rolling power can be decreased. In addition, since the deflection of the upper work roll 1 can be freely adjusted, the flatness of the rolled product can be freely controlled. The construction of the second embodiment is simpler than that of the first embodiment.

As shown in the right half section of FIG. 4, even when the position of the upper work roll 1 is vertically moved in order to roll a stock or workpiece into a thin rolled product, the work roll 1 and the pressure roll 7 can vertically move in unison with each other because the bearing box 8 of the latter is pivoted with the pin 20 to the bearing box 26 of the former (as indicated by the imaginary lines in the left half section of FIG. 4). Therefore the apparatus can follow the variation in thickness of the product.

In both the first and second embodiments, the intermediate roll 6 is interposed between the upper backup roll 3 and the upper work roll 1 so that the pressure roll 7 is disposed on the side of the upper work roll 1, but it is to be understood that when the intermediate roll 6 is interposed between the lower work and backup rolls 2 and 4, the pressure roll 7 is disposed on the side of the lower work roll 2.

The effects, features and advantages of the present invention can be summarized as follows:

(i) The intermediate roll is horizontally bent so as to adjust the deflection of the work roll, whereby the flatness of the rolled product can be freely controlled.

(ii) The rolling or reduction force and consequently the rolling power can be decreased.

(iii) The pressure roll can be disengaged from the pressing device so that the rolls can be replaced as a unit in a simple manner.

(iv) The construction is simple so that application to the existing rolling mill is facilitated.

What is claimed is:

1. A rolling mill comprising upper and lower work rolls, upper and lower backup rolls, an intermediate roll interposed between at least one of said work rolls and the corresponding backup roll, said intermediate roll being offset in the direction of a rolling line, a pressure roll disposed on the intermediate roll offset side and abutting on said intermediate roll, said pressure and intermediate rolls having bearing boxes, the bearing boxes of said pressure roll being respectively engaged with the bearing boxes of said intermediate roll so as to be movable in the direction of the rolling line, the bearing boxes of the pressure roll being vertically immovable with respect to the bearing boxes of the intermediate roll, and means disposed on the intermediate roll offset side for pressing said pressure roll against said intermediate roll.

2. A rolling mill according to claim 1 wherein said pressing means are mounted on a beam extended between housings of the rolling mill.

3. A rolling mill according to claim 2 wherein said pressing means are disposed so as to be vertically movable.

4. A rolling mill according to claim 1 wherein said pressing means are disposed so as to be vertically movable.

5. A rolling mill comprising upper and lower work rolls, upper and lower backup rolls, an intermediate roll interposed between at least one of said work rolls and the corresponding backup roll, said intermediate roll being offset in the direction of a rolling line, a pressure roll disposed on the intermediate roll offset side and abutting on said intermediate roll, and means disposed on the intermediate roll offset side for pressing said pressure roll against said intermediate roll, said pressing means being mounted on bearing boxes of the corresponding backup roll, one end of the bearing boxes of said pressure roll being engaged with said pressing means while the other ends thereof being pivoted to bearing boxes of the corresponding work roll.

* * * * *